US005484093A

United States Patent [19]

Hellweg et al.

[11] Patent Number: 5,484,093

[45] Date of Patent: Jan. 16, 1996

[54] MAGAZINE POUCH

[76] Inventors: Albert W. Hellweg, 84 Terrara Road, Vermont, Victoria, Australia; Kerby C. Smith, 42827 Bean Gulch Ranch Rd., Coarsegold, Calif. 93614

[21] Appl. No.: 189,907

[22] Filed: Jan. 28, 1994

[30] Foreign Application Priority Data

Feb. 11, 1993 [AU] Australia ..... PL7231

[51] Int. Cl.[6] ..... A45F 5/00

[52] U.S. Cl. ..... 224/253; 224/914; 224/931

[58] Field of Search ..... 224/253, 191, 224/234, 239, 240, 911, 914, 902, 252, 232, 904, 931

[56] References Cited

U.S. PATENT DOCUMENTS

| | | | |
|---|---|---|---|
| 368,578 | 8/1887 | Frazier | 224/253 |
| 2,349,107 | 5/1944 | Murtaugh | 224/239 |
| 3,128,926 | 4/1964 | Stella . | |
| 3,130,883 | 4/1964 | Mackool | 224/253 |
| 3,938,717 | 2/1976 | Theodore | 224/253 |
| 4,588,116 | 5/1986 | Litman | 224/253 |
| 4,600,133 | 7/1986 | Maihos | 224/232 |
| 4,759,483 | 7/1988 | Willoughby | 224/253 |
| 4,961,523 | 10/1990 | Stimac | 224/232 |
| 5,209,383 | 5/1993 | Theodore . | |
| 5,251,798 | 10/1993 | Theodore . | |
| 5,251,799 | 10/1993 | Theodore . | |

*Primary Examiner*—Henry J. Recla
*Assistant Examiner*—Charles R. Eloshway
*Attorney, Agent, or Firm*—Calfee Halter & Griswold

[57] ABSTRACT

A magazine pouch having a main body portion and a belt loop portion, the main body portion and the belt loop portion being formed as a one-piece construction, the main body portion having an open top for receiving a magazine therein, and a closed bottom to retain the magazine, the main body portion having two substantially parallel but spaced apart ends defining an open side therebetween, there being provided at least one fastener passing between the ends and across the open side to maintain the ends in a desired but spaced relationship.

5 Claims, 1 Drawing Sheet

MAGAZINE POUCH

TECHNICAL FIELD

This invention relates to a magazine pouch and refers particularly, though not exclusively, to a magazine pouch wherein a one-piece construction is used.

BACKGROUND OF THE INVENTION

Magazine pouches are used by those bearing arms to hold magazines pre-loaded with ammunition. With pistols, in particular, the magazine pouches are used so that law enforcement officers can maintain fire without taking an unduly large time to re-load. In the past magazine pouches have been mounted on the belt or the strap for a shoulder holster of the wearer and have been used to retain the magazine in position. However, with variations of pistols, and thus variations in magazines, a very large number of different pouches have had to be designed and manufactured thus increasing costs. Also, an individual could not adjust the magazine to suit the temperament and desires of the user so that the tension on the magazine when held in position was fixed and thus may not have been suitable for all persons. Furthermore, with magazine pouches as made previously, a multi-part magazine pouch has been used, which required extensive processing and this also increased costs.

It is the principle object of the present invention to provide a magazine pouch which is a one-piece construction.

It is a further object to find a magazine pouch where it is possible for a tension device to be adjustable.

SUMMARY OF THE INVENTION

With the above and other objects in mind the present invention provides a magazine pouch having a main body portion and a belt loop portion, said main body portion and said belt loop portion being formed as a one-piece construction, said main body portion having an open top for receiving a magazine therein, and a closed bottom to retain said magazine, said main body portion having two substantially parallel but spaced apart ends defining an open side therebetween, there being provided at least one fastener passing between said ends and across said open side to maintain said ends in a desired but spaced relationship.

So that the invention can be readily understood there shah now be described by way of non-limitative example only a preferred construction of a magazine pouch incorporating the principal features of the present invention, the description being by way of non-limitative example only and with reference to the accompanying illustrative drawings.

DETAILED DESCRIPTION

Figure 1:
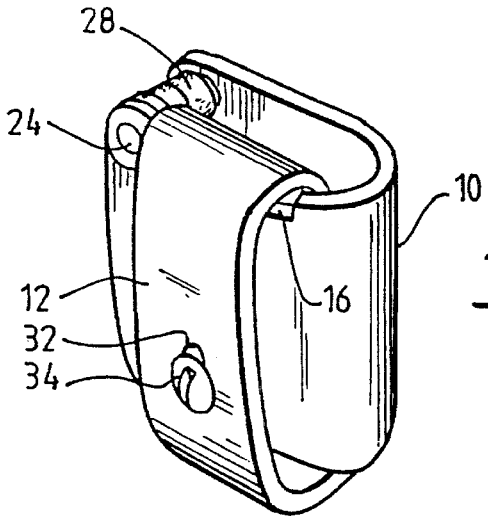
FIG. 1 is a rear perspective view of the magazine pouch of the present invention.

As shown in the drawings, there is a magazine pouch which has a main body portion 10 and a belt loop portion 12 having an enlarged outer end 14.

Figure 4:
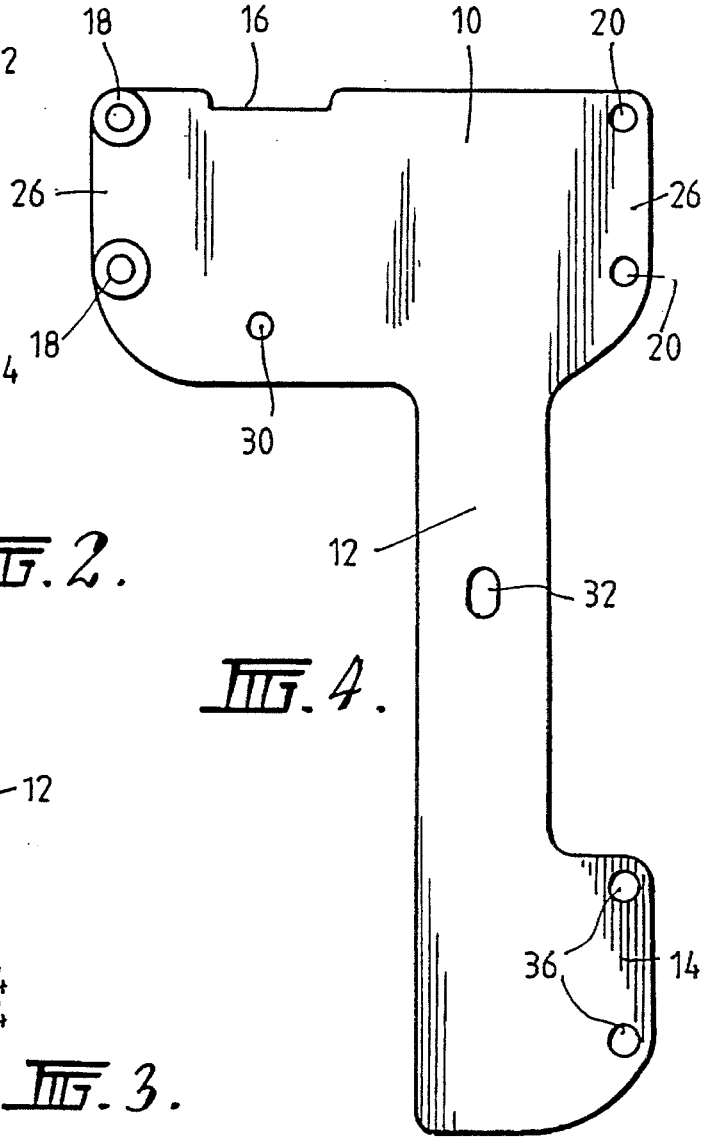
FIG. 4 is the material blank of the magazine pouch prior to folding.

As can be seen from FIG. 4, the main body portion 10 is approximately rectangular, although with rounded corners. A cut-out 16 is provided so that upon the main body portion 10 being folded about its central, longitudinal axis (as viewed in FIG. 4) the cut-out 16 will be aligned with and opposite to the belt loop portion 12. This then enables the belt loop portion 12 to be folded over the already folded main body portion 10 such that the main loop portion 12 passes over and can rest in the cut-out 16. The enlarged portion 14 can then pass inside the main body portion 10.

As can be seen, the main body portion 10 has five holes therethrough arranged as a first pair of holes 18 and, at the opposite end, a second pair of holes 20. Naturally, when the main body portion 10 is folded as described above, the holes 18 align with the holes 20. In this way, a bolt 22 can be used to pass through each of the holes 18, 20 and engage with a captive nut 24 to secure the ends 26 of the main body portion 10 in an appropriate relationship. Obviously, by adjusting the tension on the bolt 22 with the captive nut 24 the distance between the end 26 can be adjusted. Preferably spacers 28 are provided over the bolts 22 so that the ends 26 will be held in a fixed position, upon the tightening of the bolt 22. However, as is clear from FIGS. 2 and 3, the number of spacers can be varied so that the gap between the ends 26 is also varied.

A further hole 30 is provided in the main body portion 10 and this cooperates with a hole 32 in the belt loop portion 12 so that upon the pouch being folded, a further bolt 34 with a captive nut (not shown) can be used to retain the belt loop portion 12 in position in relation to the main body portion 10. This also forms an adjustable form of belt loop.

Figure 2:
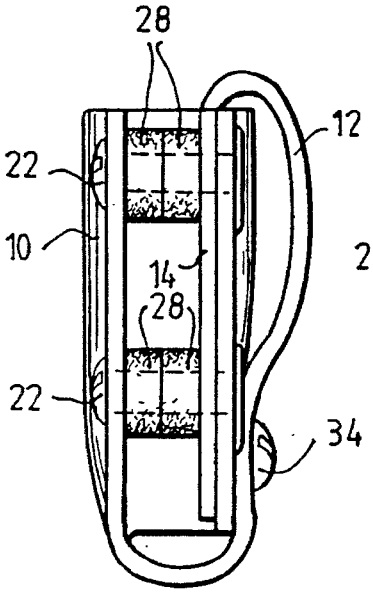
FIG. 2 is an end view of the magazine pouch of FIG. 1.
Figure 3:
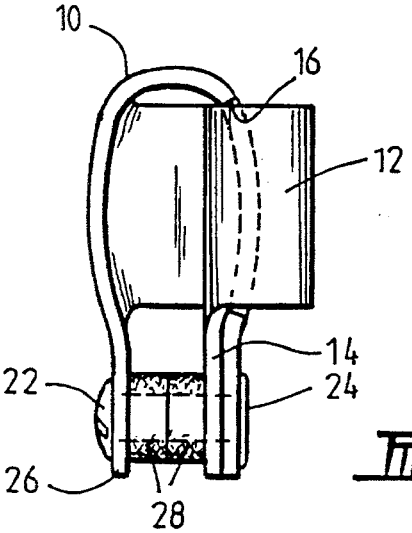
FIG. 3 is a top-plan view of the magazine pouch of FIGS. 1 and 2.

Preferably the enlarged portion 14 has holes 36 so that the enlarged portion 14 of belt loop portion 12 can be retained in position in relation to the main body portion 10—see FIG. 2.

Throughout this specification reference to pouch should not be limited to use as a magazine pouch. The invention is equally applicable for any situation where a one-piece construction pouch, preferably with tension adjustment, may be desirable. This would include situations such as baton holders, hand cuff holders, and the like.

If desired the pouch as described in the foregoing description may be mounted on a plate in a manner such as to be able to be vertically and rotationally adjustable thereto. This could be done by having a plate with a slot therein and which uses a bolt and nut passing through a hole, such as the hole 32.

Whilst there has been described in the foregoing description a preferred construction of a pouch incorporating the principal features of the present invention, it will be understood by those skilled in the art that many variations or modifications in design may be made without departing from the essential features of the present invention.

We claim:

1. A variable tension magazine pouch comprising a main body portion and a belt loop portion, said main body portion and said belt loop portion being formed from a single folded piece, said main body portion having an open top for receiving a magazine therein, and a closed bottom to retain said magazine, said main body portion having two substantially parallel but spaced apart ends defining an open side therebetween, there being provided at least two fasteners passing between said ends and across said open side to maintain said ends in a spaced relationship, each of said fasteners comprising a bolt passing through one of said ends and co-operating with a captive nut on the other of said ends, said bolt being adapted to receive thereabout at least one spacer between said ends for maintaining said ends spaced apart, said belt loop portion extending downwardly from and underneath said main body portion to form said bottom.

2. A magazine pouch as claimed in claim 1, wherein said belt loop portion further extends behind said main body portion and into said open top, said open top, said belt loop portion also being secured by said and is secured to said main body portion.

3. A magazine pouch as claimed in claim 2, wherein said belt loop portion has a sleeve portion inside said main body portion which extends to said open side so as to be secured by said fasteners.

4. A magazine pouch as claimed in claim 2, wherein a section of said belt loop portion above said sleeve is attached to said main body portion above but adjacent to said bottom.

5. A magazine pouch comprising a main body portion and a belt loop portion, said main body portion and said belt loop portion being formed as a one-piece construction, said main body portion having an open top for receiving a magazine therein, and a closed bottom to retain said magazine, said main body portion having two substantially parallel but spaced apart ends defining an open side therebetween, there being provided at least one fastener passing between said ends and across said open side to maintain said ends in a desired but spaced relationship;

wherein said belt loop portion extends downwardly from and underneath said main body portion to form said bottom;

wherein said belt loop portion further extends behind said main body portion and into said open top, and wherein said belt loop portion has a sleeve portion inside said main body portion which extends to said open side so as to be secured by said at least one fastener.

* * * * *